US007703507B2

(12) United States Patent
Strickland

(10) Patent No.: US 7,703,507 B2
(45) Date of Patent: Apr. 27, 2010

(54) DOWNHOLE TOOL DELIVERY SYSTEM

(75) Inventor: Dennis A. Strickland, Norman, OK (US)

(73) Assignee: Intelligent Tools IP, LLC, Norman, OK (US)

( * ) Notice: Subject to any disclaimer, the term of this patent is extended or adjusted under 35 U.S.C. 154(b) by 0 days.

(21) Appl. No.: 11/969,707

(22) Filed: Jan. 4, 2008

(65) Prior Publication Data

US 2009/0173487 A1 Jul. 9, 2009

(51) Int. Cl.
*E21B 29/00* (2006.01)
*E21B 47/00* (2006.01)

(52) U.S. Cl. ..... 166/55.1; 166/255.1; 166/297; 166/66; 166/188; 166/133

(58) Field of Classification Search ..... 166/255.2, 166/297, 55.1, 66, 66.6, 188, 133, 250.1, 166/250.11, 255.1, 135, 192, 153
See application file for complete search history.

(56) References Cited

U.S. PATENT DOCUMENTS 6,003,597 A * 12/1999 Newman ..... 166/55.1
6,055,213 A * 4/2000 Rubbo et al. ..... 367/82
6,394,184 B2 5/2002 Tolman et al.
6,520,255 B2 2/2003 Tolman et al.
6,543,538 B2 4/2003 Tolman et al.
6,567,235 B2 5/2003 Kasetty et al.
6,634,425 B2 * 10/2003 King et al. ..... 166/253.1
6,837,310 B2 1/2005 Martin
6,880,637 B2 4/2005 Myers, Jr. et al.
6,930,858 B2 8/2005 Gunderson et al.
6,957,701 B2 10/2005 Tolman et al.
6,970,322 B2 11/2005 Bernett
7,019,942 B2 3/2006 Gunderson et al.
7,021,388 B2 * 4/2006 Williams ..... 166/372
7,059,407 B2 6/2006 Tolman et al.
7,316,274 B2 * 1/2008 Xu et al. ..... 166/285
7,322,416 B2 1/2008 Burris, II et al.
7,363,967 B2 4/2008 Burris, II et al.
2001/0050172 A1 12/2001 Tolman et al.
2002/0007949 A1 1/2002 Tolman et al.

(Continued)

FOREIGN PATENT DOCUMENTS

GB 2 240 798 A 8/1991

*Primary Examiner*—Jennifer H Gay
*Assistant Examiner*—Yong-Suk Ro
(74) *Attorney, Agent, or Firm*—Daniel P. Dooley; Fellers, Snider, et al.

(57) ABSTRACT

An apparatus for use in deployment of downhole tools is disclosed. Preferably, the apparatus includes at least an in-ground well casing, a housing providing a hermetically sealed electronics compartment, a tool attachment portion, and a first flow through core. The housing is preferably configured for sliding communication with the well casing. The hermetically sealed electronics compartment secures a processor and a location sensing system, which communicates with the processor while interacting exclusively with features of the well casing to determine the location of the housing within the well casing. A preferred embodiment further includes a well plug affixed to the tool attachment portion, the well plug includes a second flow through core capped with a core plug with a core plug release mechanism, which upon activation provides separation between the second flow through core and the core plug, allowing material to flow through said first and second flow through cores.

16 Claims, 11 Drawing Sheets

U.S. PATENT DOCUMENTS

| | | | | |
|---|---|---|---|---|
| 2002/0092650 | A1 | 7/2002 | Tolman et al. | |
| 2003/0051876 | A1 | 3/2003 | Tolman et al. | |
| 2003/0192696 | A1 | 10/2003 | Myers, Jr. et al. | |
| 2004/0104029 | A1 | 6/2004 | Martin | |
| 2005/0178551 | A1 | 8/2005 | Tolman et al. | |
| 2005/0194174 | A1 | 9/2005 | Hipwell, Jr. et al. | |
| 2006/0050429 | A1 | 3/2006 | Gunderson et al. | |
| 2006/0072241 | A1 | 4/2006 | Feliss et al. | |
| 2006/0288769 | A1* | 12/2006 | Odom | 73/152.22 |
| 2008/0053654 | A1* | 3/2008 | Ullah et al. | 166/250.1 |

* cited by examiner

DOWNHOLE TOOL DELIVERY SYSTEM

FIELD OF THE INVENTION

This invention relates to downhole tool delivery systems, and in particular, but not by way of limitation, to a wellbore casing depth sensing system having an ability to deliver downhole tools while interacting exclusively with features of the casing to determine the location of the downhole tool within the casing, relative to the surface.

BACKGROUND

Deployment of downhole tools, such as bridgeplugs, fracplugs, and downhole monitoring devices within casings of downhole well bores, is a time consuming and expensive undertaking. Attaining a desired predetermined depth requires continuous monitoring of the amount of wire line, jointed tubing or coiled tubing secured to the tool that has been dispensed to transport the tool to the desired depth. At times, the tool being deployed hangs up in the casing, or the wire line becomes tangled and lodged in the casing, or may become disassociated from the tool, requiring retrieval and redeployment of the tool, thereby compounding the tool deployment task.

Market pressures continue to demand improvements in downhole tool design and methods of deploying the same to stem the cost of recovering energy resources. Accordingly, challenges remain and a need persists for improvements in methods and apparatuses for use in accommodating effective and efficient deployment of downhole tools.

SUMMARY OF THE INVENTION

In accordance with preferred embodiments, an apparatus includes at least a wellbore confining a well casing, a hermetically sealed housing providing a hermetically sealed electronics compartment, a tool attachment portion, and a first flow through core is provided. The housing is preferably configured for sliding communication with the well casing. The hermetically sealed electronics compartment is configured to secure a processor and an accompanying location sensing system. Preferably, the location sensing system communicates with the processor while interacting exclusively with features of the well casing to determine the location of the hermetically sealed housing within the well casing, as the hermetically sealed housing proceeds along the interior of the well casing.

A preferred embodiment further includes a well plug with a second flow through core. The preferred well plug includes an integrated setting tool, and is affixed to the tool attachment portion of the hermetically sealed housing and the second flow through core is in communication with the first flow through core. The preferred well plug further includes a core plug affixed to the second flow through core and prohibits material flow through said first and second flow through cores.

To facilitate material flow through the first and second flow through cores, a core plug release mechanism is provided adjacent the core plug, which upon activation, provides separation between said second flow through core and the core plug.

In an alternate preferred embodiment, the hermetically sealed electronics compartment further secures a perforating device interface and activation module, communicating with the processor and activating a perforation device in response to an activation and conformation of the well plug being set in position within the well casing. The perforation device is preferably a perforation gun. However, as those skilled in the art will appreciate, other devices such as strip guns and perforating bullets are suitable substitutes.

The perforation device is preferably secured to the hermetically sealed housing via a second of the pair of attachment portions of the hermetically sealed housing. The perforating device interface and activation module preferably includes a charge module communication circuit interacting with a charge deployment device of the perforation device. The perforation device as a perforation gun preferably further includes a shape charge offset a predetermined distance from the attachment portion and positioned to form a perforation through the well casing upon detonation of the shape charge by charge deployment device.

These and various other features and advantages that characterize the claimed invention will be apparent upon reading the following detailed description and upon review of the associated drawings.

DETAILED DESCRIPTION OF A PREFERRED EMBODIMENT

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
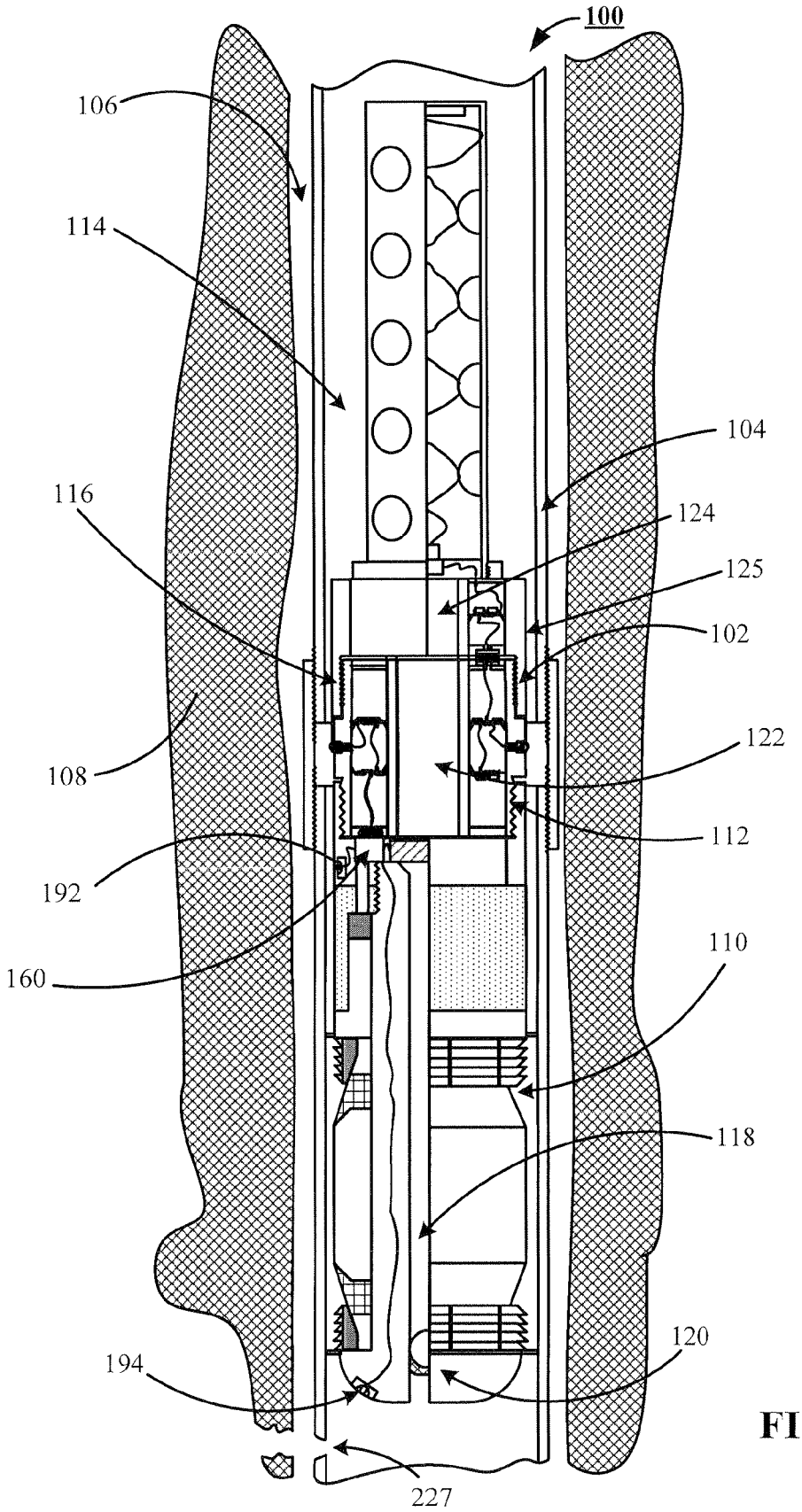
FIG. 1 shows a cross-sectional and partial cross-sectional view in elevation of an inventive downhole tool delivery system positioned within a well casing of a wellbore.

Reference will now be made in detail to one or more examples of the invention depicted in the figures. Each example is provided by way of explanation of the invention, and not meant as a limitation of the invention. FIG. 1 shows an inventive downhole tool delivery system 100 that preferably includes a depth determination device 102, in sliding confinement within a well casing 104 of a wellbore 106 in the earth 108. The downhole tool delivery system 100 further preferably includes a well plug 110 affixed to a first module attachment portion 112 (also referred to herein as a first tool attachment portion), of the depth determination device 102, and a perforation device 114 [in the form of a perforation gun 114] affixed to a second module attachment portion 116 (also referred to herein as a second tool attachment portion).

In a preferred embodiment, the well plug 110 includes a setting tool, and is a flow through frac plug with a flow through core 118 fitted with a check valve 120. The check valve 120 allows unidirectional flow of fluidic material from within the wellbore 106, through the flow through core 118. The flow through core 118 communicates with a flow through chamber 122 of the depth determination device 102. Preferably, the flow through chamber 122 of the depth determination device 102 interacts with a flow through channel 124 of an attachment portion 125 of the perforation gun 114.

Figure 2:
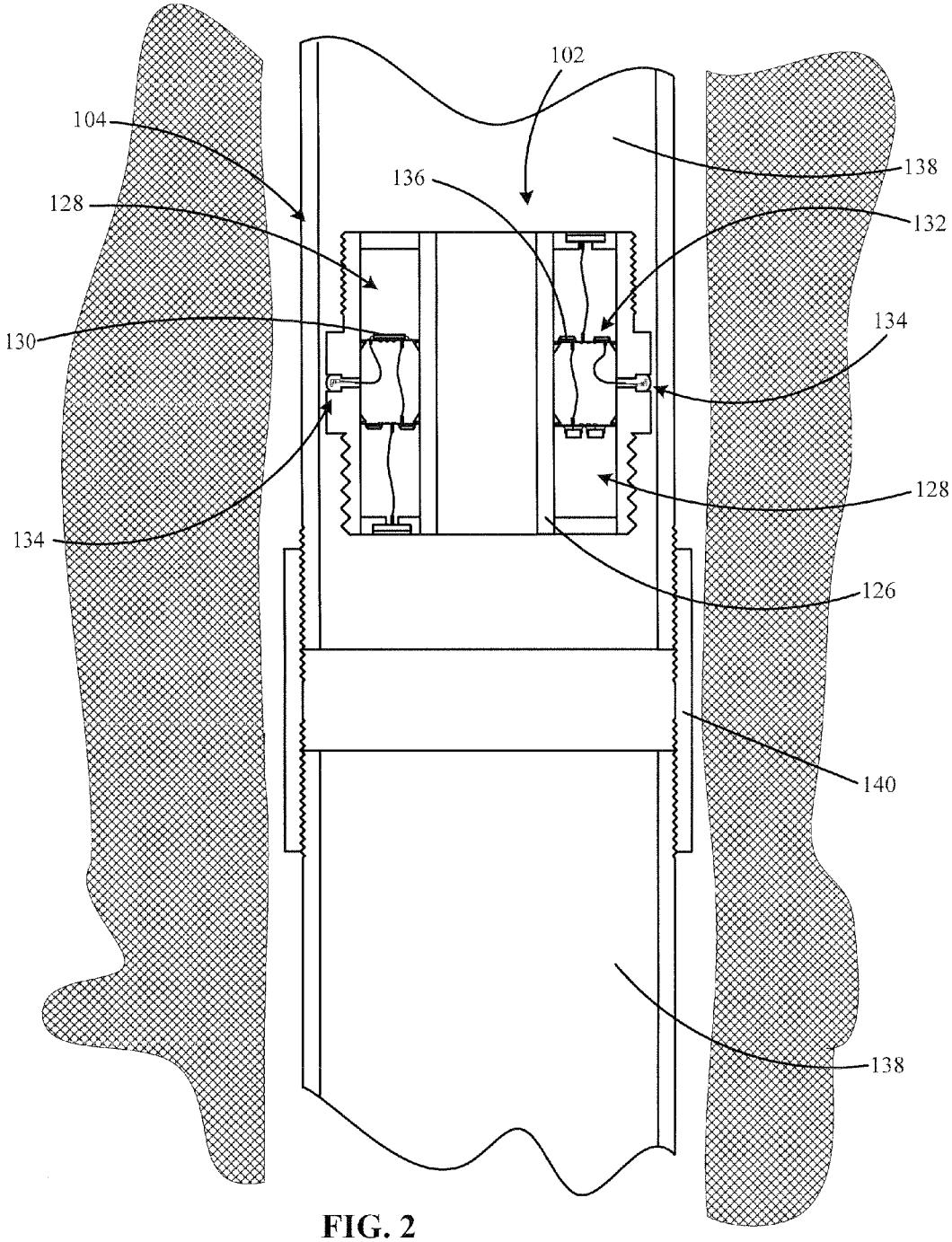
FIG. 2 illustrates a cross-sectional view in elevation of a location sensing system integrated within a hermetically sealed electronics compartment of a hermetically sealed housing of a depth determination device in sliding communication with the well casing of FIG. 1.

As shown by FIG. 2, the depth determination device 102 preferably includes a housing 126 in sliding communication with the well casing 104. The housing 126 preferably provides a hermetically sealed electronics compartment 128, within which is secured a processor 130. The hermetically sealed electronics compartment 128 further supports a location sensing system 132 (also referred to herein as a depth control module) integrated within the hermetically sealed electronics compartment 128, and communicating with the processor 130, the location sensing system 132 interacts exclusively with features of well casing 104 preferably through use of location sensors 134 (such as 871™ inductive proximity sensors by Rockwell Automation of Milwaukee Wisconsin, U.S.A.), which communicate with a sense circuit 136 to determine a location of the housing 126 within the well casing 104. In a preferred embodiment, the well casing 104 includes a plurality of adjacent pipe portions 138 secured together by coupling portions 140.

Figure 3:
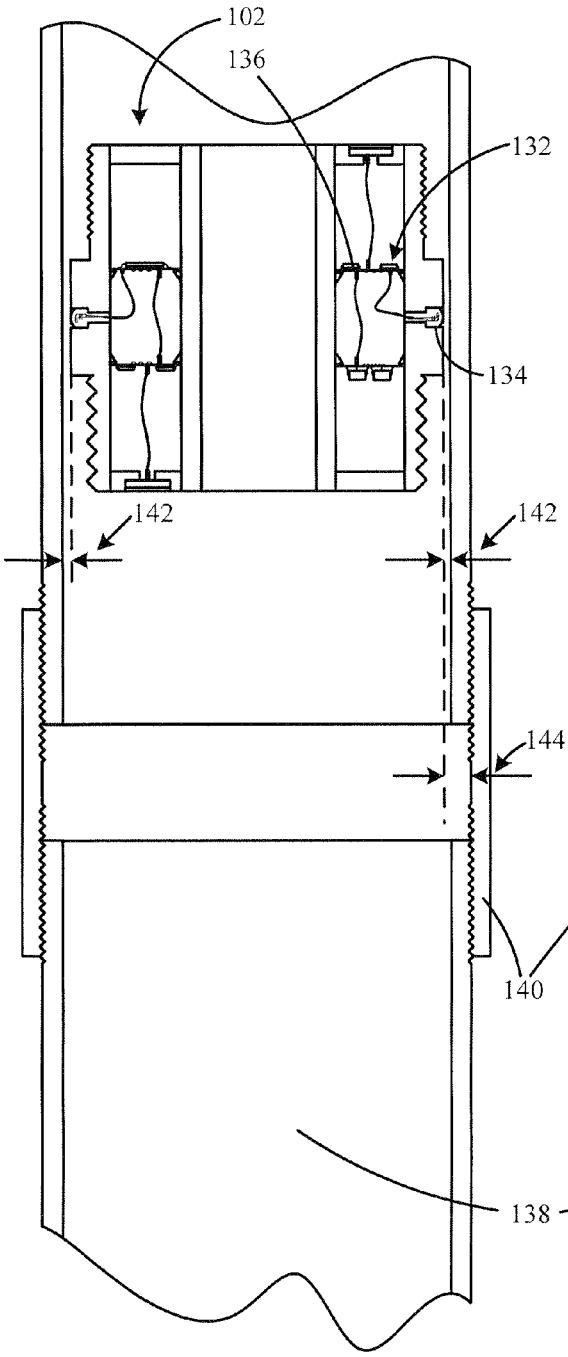
FIG. 3 depicts a cross-sectional view in elevation of the location sensing system of the depth determination device interacting with the well casing of FIG. 1.
Figure 4:
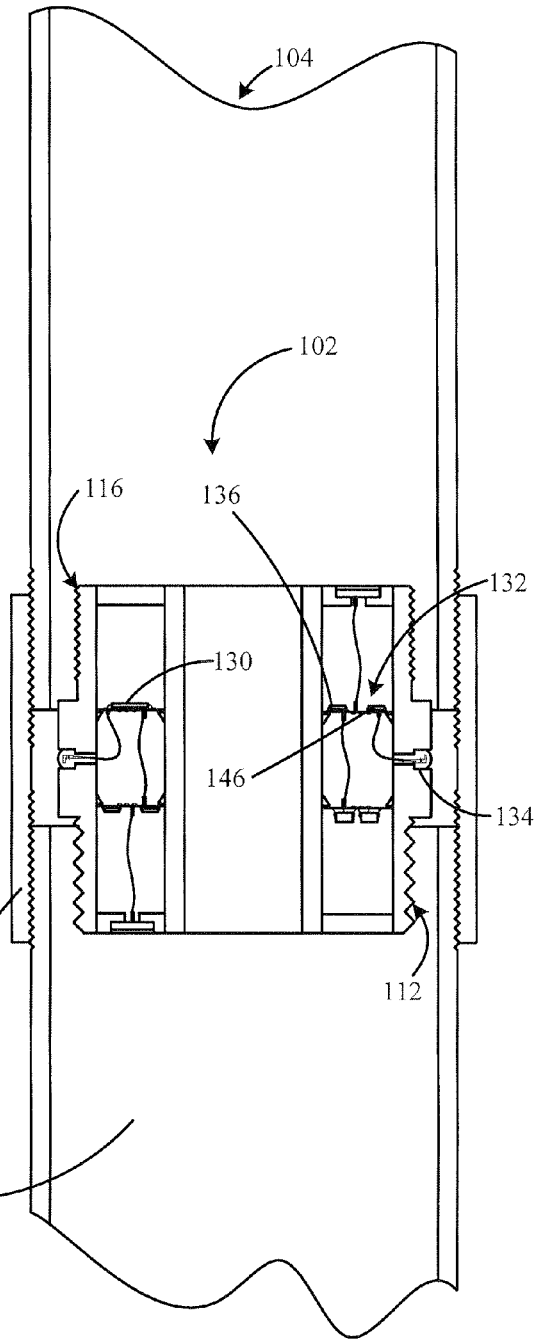
FIG. 4 portrays a cross-sectional view in elevation of the location sensing system of the depth determination device interacting with a coupling of the well casing of FIG. 1.

In a preferred embodiment, the location sensors 134 are inductive proximity sensors, which measure, within the range of the device, a distance from the location sensors 134 to a magnetically sympathetic object is located. In a preferred embodiment, a plurality of location sensors 134 are used to determine an average distance from the housing 102 the well casing 104 is located. As shown by FIGS. 3 and 4, the pipe portions 138 and coupling portions 140 are offset from the housing by a distance 142 and 144 respectfully. By continually monitoring the location sensors 134 with the sense circuit 136, the sense circuit 136 provides the processor 130 with a plurality of input signals from which the processor 130 determines whether the housing 102 is adjacent a pipe portion 138, or a coupling portion 140. In an alternate embodiment, the location sensors 134 are casing collar locators, which detect the mass of the coupling portions 140.

By loading a casing map (i.e., a record of the length of pipe portion 138 between each coupling 140, along the length of the casing 104), into a memory 146 of the location sensing system 132, the processor 130 can determine the relative position and velocity of the housing 102 as it passes through the casing 104. In a preferred embodiment, a short section of pipe portion 138 is introduced into the string of portion pipes 140, as the well casing 104 is being introduced and assembled into the well bore 106. The short sections of portion pipe 138, serve as a marker for a particular depth along the well casing 104.

By detecting the first coupling portion 140 within the well casing 104 and comparing the first detected coupling portion 140 to the casing map, the processor 130 determines the relative location of the housing 102 within the well casing 104. By timing an elapse time between the first encountered coupling portion 140 and the second encountered coupling portion, the processor 130 can determine the velocity of travel of the housing 102 as it is being pumped down the well casing 104. By knowing the velocity of travel of the housing 102 as it proceeds through the well casing 104, the distance to the next coupling portion 140 (based on the casing map), the processor 130 can predict when the next coupling portion 140 should be encountered, and if the next coupling portion 140 to be encountered is encountered within a predetermined window of time, the relative position, velocity, and remaining distance to be traveled by the housing 102 will be known by the processor 130. With the relative position, velocity, and remaining distance to be traveled by the housing 102 known by the processor 130, the processor 130 can determine when to deploy well plug 148 of FIG. 5.

Figure 5:
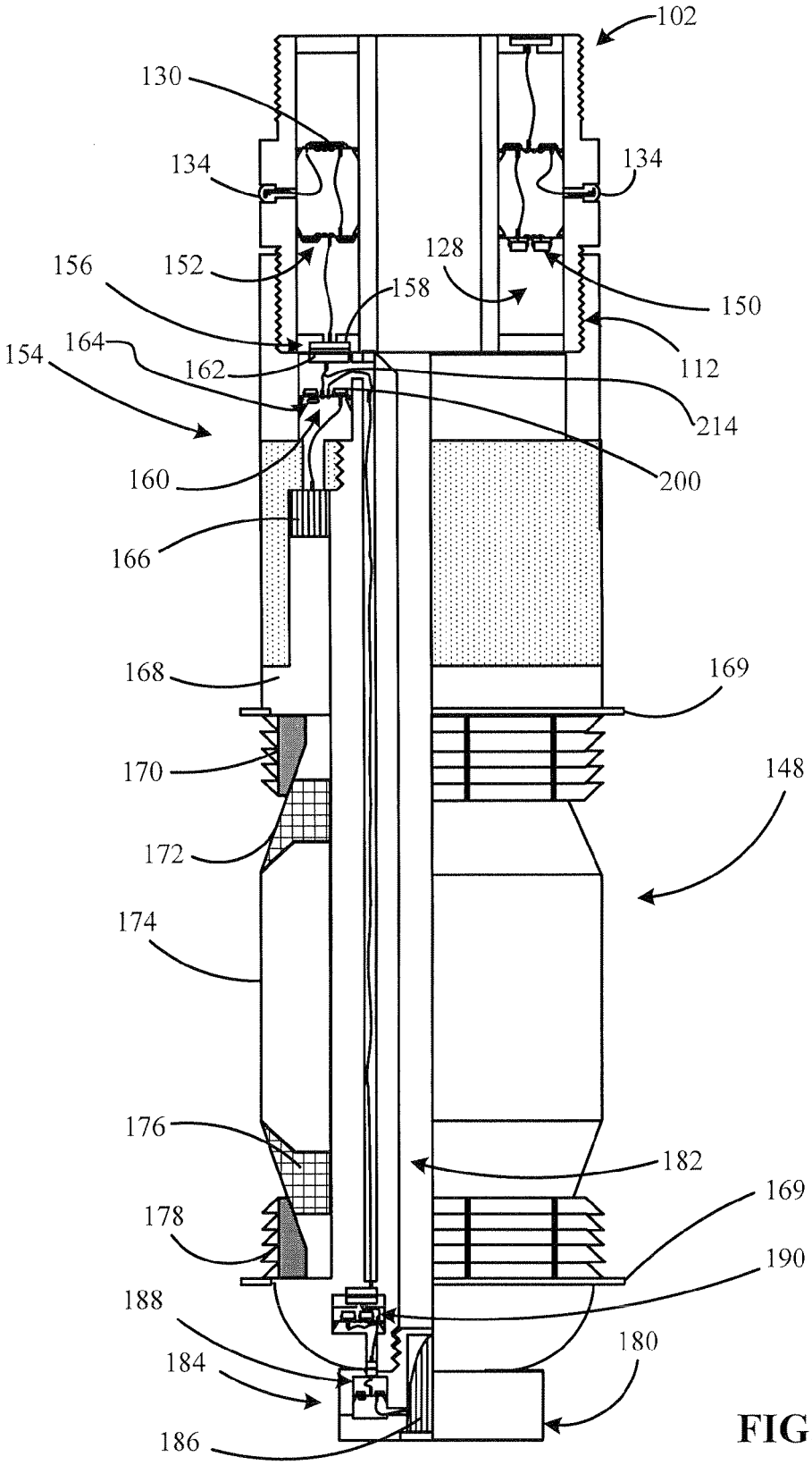
FIG. 5 reveals a cross-sectional and partial cross-sectional view in elevation of a well plug with setting tool secured to the depth determination device of FIG. 2.

As shown by FIG. 5, the hermetically sealed electronics compartment 128 further provides a well plug interface and activation module 150 (also referred to herein as a well plug activation circuit), which includes a well plug communication circuit 152 that interacts with a well plug deployment device 154 (also referred to herein as a plug activation mechanism) of the well plug 148. In a preferred embodiment, the module attachment portion 112 provides a communication port 156, which preserves the hermetically sealed electronics compartment 128 while accommodating passage of light transmissions from the housing 102 to the well plug 148. Preferably, the well plug interface and activation module 150 further includes a light source transmitter 158 responsive to the well plug communication circuit 152 for communicating with said well plug deployment device 154.

Preferably, the well plug deployment device 154 includes a well plug deployment circuit 160, a light source receiver 162 interacting with the well plug deployment circuit 160, and responsive to the light source transmitter 158 for communicating with the well plug deployment circuit 160. Power is preferably provided to the well plug deployment circuit 160 via a power cell 164. The well plug deployment device 154 further preferably includes a set plug charge 166 responsive to the well plug deployment circuit 160, a piston 168 (also referred to herein as a well plug set mechanism) adjacent the set plug charge 166, and a pair of wipes 169. The pair of wipers 169 serve to stabilize the well plug 148 during the decent of the well plug 148 through the casing 104 (of FIG. 1).

In a preferred embodiment, when the set plug charge 166 is activated, a charge force drives the piston 168 against a slip portion 170 of the well plug 148. Upon engaging the slip portion 170, the slip portion 170 engages a cone portion 172 of the well plug 148, causing the cone portion 172 to compress a seal portion 174 while expanding the diameter of the slip portion 170. The compression of the seal portion 174 drives a second cone portion 176 into engagement with a lower slip portion 178, and expands the diameter of the seal portion 174 and the lower slip portion 178. The preferred result of the expansion of the slip portion 170, the seal portion 174, and the lower slip portion 178 is that the slip portion 170, and the lower slip portion 178 engage the inner wall of the well casing 104 (of FIG. 1) to lock the position of the well plug 148 within the well casing 104, while the expanded seal portion 174 engages the inner wall of the well casing 104 to seal the portion of the well casing 104 below the well plug 148 off from the portion of the well casing 104 above the well plug 148.

As further shown by FIG. 5, the well plug 148 preferably selectively serves as a permanent bridge plug or a temporary bridge plug. By providing a core plug 180 affixed to a flow through core 182 of the well plug 148, the well plug 148 serves as a permanent bridge plug, which enables that portion of the well casing 104 (of FIG. 1) below the permanent bridge plug to be sealed from that portion of the well casing 104 above the permanent bridge plug. By providing the core plug 180 with a core plug release mechanism, such as 184, the well plug 148 provides a temporary bridge plug, which temporarily isolates that portion of the well casing 104 below the temporary bridge plug from that portion of the well casing 104 above the well plug 148.

In a preferred embodiment, the core plug release mechanism 184 includes a charge 186, which is responsive to a core charge control circuit 188. The core charge control circuit 188 communicates with the processor 130 via a core communication circuit 190, which interacts with the well plug deployment circuit 160. Following the expansion of the slip portion 170, the seal portion 174, and the lower slip portion 178, the processor 130 queries first and second pressure transducers 192 and 194 (of FIG. 1), to determine whether a seal has been formed between the well plug 148 and the well casing 104. Each pressure transducer (192, 194) signals pressure data to the well plug deployment circuit 160 (of FIG. 1), which communicates the pressure data to the processor 130. The processor 130 determines whether a proper seal has been achieved by the deployment of the seal portion 174. If a proper seal has been achieved, following a predetermined period of time, the processor 130 signals the charge control circuit to ignite the charge 186, which explodes the core plug 180, to allow material flow from below, or above the well plug 148 to proceed through the flow through core 182.

In a preferred embodiment the well plug 148 with integrated setting tool, (as well as the associated down hole devices) are constructed from a drillable material, that include but is not limited to aluminum, carbon fiber, composite materials, high temperature polymers, cast iron, or ceramics. The purpose for the use of drillable materials for the construction of the well plug 148 is to assure that the entire well plug 148 can be quickly removed from the well casing 104, to minimize flow obstructions for material progressing through the well casing 104.

In a preferred embodiment, following deployment of the seal portion 174, the pressure within the casing 104 above the well plug 130 will increase, relative to the pressure within the casing 104 below the well plug 148, as pump-down material continues to be supplied into the casing 104 above the well plug 148. Following a predetermined period of time, the pump-down material is relieved from above the well plug 148, thereby reducing the pressure within the casing 104 above the well plug 148, relative to the pressure within the casing 104 below the well plug 148. These changes in pressure are detected by the first and second pressure transducers 192 and 194 (of FIG. 1), which in conjunction with the processor 130 determines whether a proper seal has been achieved by the deployment of the seal portion 174.

Additionally, based on the determined velocity of the housing 104 and the casing map, the processor 130 can predict when within a predetermined time period, the next coupling portion 140 will be encountered. If the next coupling portion 140 is not encountered (i.e., a drop in the measured field strength of the location sensors 134, indicative of the presence of a coupling portion 140, is not sensed), within the predetermined time period, the processor 130 determines when a subsequent coupling portion 140 should be encountered based on: the last determined velocity; the last determined location of the housing 102; the casing map; and a predetermined time period. If the subsequent coupling portion 140 is not detected, the processor 130 sets up for the next subsequent coupling portion 140. If three coupling portions 140 in sequence fail to be detected, the processor deactivates all circuits, with the exception of the sense circuit 136, and goes into a sleep mode.

If however, one of the three coupling portions 140 is detected, the processor recalculates three velocities for the housing 102 traveling within the well casing 104. The first calculated velocity assumes the first of the three coupling portions 140 was in reality detected, and the reason that the first coupling portion 140 had been reported as not been detected, was that the velocity of the housing 102 had slowed to a point that the allotted window of time for detecting the first of the three coupling portions 140 had expired.

The second calculated velocity assumes the first of the three coupling portions 140 was in reality not detected, but the second of the three coupling portions 140 was detected. At that point, the processor 130 recalculates the relative velocity based on the last known position of the housing 102, and the amount of elapse time between the last known position of the housing 102, and the detected second of the three coupling portions 140.

The third calculated velocity assumes the first and second of the three coupling portions 140 were in reality not detected, but the third of the three coupling portions 140 was detected. The processor 130 then recalculates the relative velocity based on the last known position of the housing 102, and the amount of elapse time between the last known position of the housing 102, and the detected third of the three coupling portions 140. As additional coupling portions 140 are detected, the processor is able to reestablish the position of the housing 102 within the casing 104, and the distance traveled along the well casing 104.

Preferably, when a first coupling portion 140 fails to be detected, the processor 130 directs the sense circuit 136 to increase the frequency of samplings from the plurality of sensors 134. The increased samples from each of the plurality of sensors 134 are analyzed for a consistence of readings. If the consistency of readings for each of the plurality of sensors 134 (or a predetermined number of the plurality of sensors 134) is each within a predetermined tolerance of the sensors 134, the processor 130 determines the housing has come to a stop, records the last calculated position, and the elapse time between the last coupling portion 140 encountered and the start time for the increased sampling frequency in a memory 196 (of FIG. 6) and the processor 130 goes into a safe sleep mode.

Following a predetermined period of time at the surface, a judgment is made (based on an absence of a detected explosion from the setting tool), and the downhole tool delivery system 100 is retrieved from the well casing 104. Upon retrieval, the last calculated position and the elapse time between the last coupling portion 140 encountered and the start time for the increased sampling frequency is downloaded from the memory 196, and used to determine a subsequent course of action. One course of action may be to change the rate used to pump the downhole tool delivery system 100 to the desired location, or volume of the material used to pump the downhole tool delivery system 100 to the desired location, or the tool may be replaced.

Figure 6:
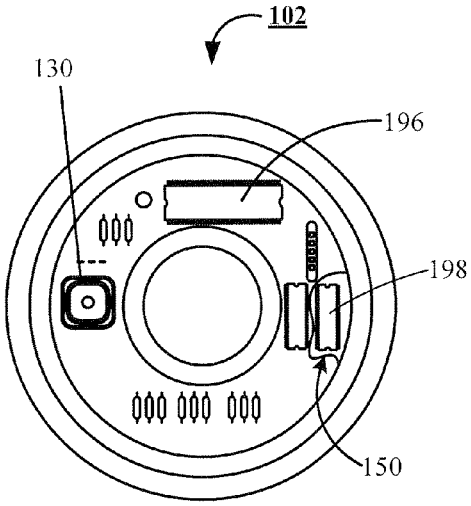
FIG. 6 shows a cross-sectional top plan view of the depth determination device of FIG. 2.
Figure 7:
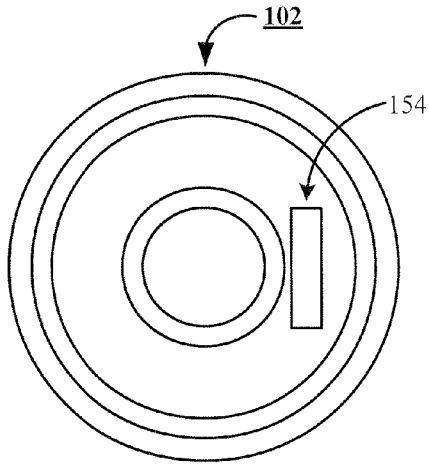
FIG. 7 illustrates a top plan view of the depth determination device of FIG. 2.

In an alternate preferred embodiment, the communication port 156 of FIG. 7, accommodates passage of radio frequency signals, and the well plug interface and activation module 150 (of FIG. 6, shown in cut away) further includes a radio frequency transmitter 198 (of FIG. 6) responsive to the well plug communication circuit 152 (of FIG. 5) for communicating with the well plug deployment device 154 (of FIG. 5).

The well plug deployment circuit 160 (of FIG. 5), of the well plug deployment device 154 (of FIG. 5), of the alternate preferred embodiment preferably includes a radio frequency receiver 200 (of FIG. 5), interacting with the well plug deployment circuit 160 and responsive to the radio frequency transmitter 198 (of FIG. 6) for communicating with the well plug deployment circuit 160.

Figure 8:
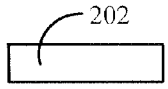
FIG. 8 depicts an elevation view of a communication port of the depth determination device of FIG. 2.
Figure 9:
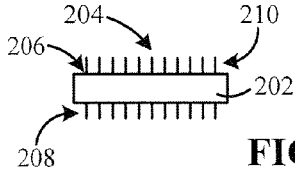
FIG. 9 portrays an elevation view of the communication port of the depth determination device of FIG. 2 providing communication pins.

In an alternative preferred embodiment, the communication port 156 of FIG. 7 accommodates a communication pin host 202 of FIG. 8, formed preferably from a ceramic, and enclosed by the communication port 156 of FIG. 7. A plurality of communication pins 204 of FIG. 9, potted in a potting compound 206 (not shown separately) secure the plurality of communication pins 204 within the communication pin host 202. Preferably, a first portion 208 of the plurality of communication pins 204 extend into the hermetically sealed electronics compartment 128 (of FIG. 12), and a second portion 210 of the plurality of communication pins 204 extend from the first module attachment portion 112 (of FIG. 12).

Figure 12:
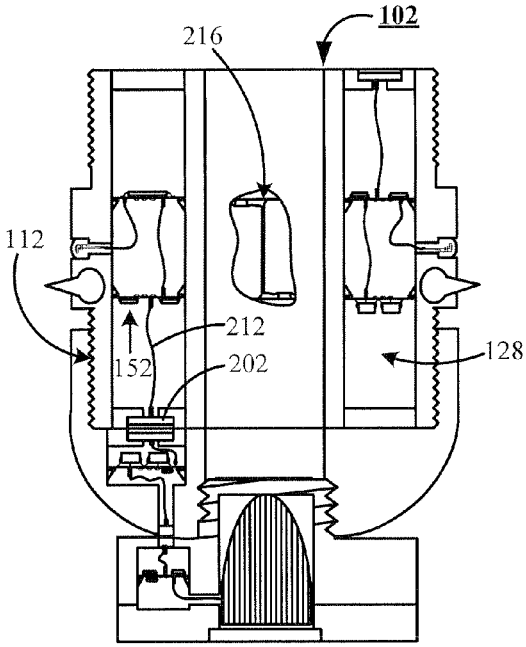
FIG. 12 illustrates a cross-sectional view in elevation of the depth determination device of FIG. 2 fitted with a core plug.

As shown by FIG. 12, the alternative preferred embodiment further includes a signal cable 212 attached to and interposed between said plurality of communication pins 204 (not shown separately) extending into said hermetically sealed electronics compartment 128, and the well plug communication circuit 152. The well plug deployment circuit 160 (of FIG. 5), of the well plug deployment device 154 (of FIG. 5), of the alternative preferred embodiment preferably includes a signal cable 214 (of FIG. 5) attached to and interposed between the second portion 210 (not shown separately) of the plurality of communication pins 204 (not shown separately) and the well plug deployment circuit 160. Preferably, energy needed to operate the electronics supported by the depth determination device 102, is provided by a portable energy source 216.

Figure 10:
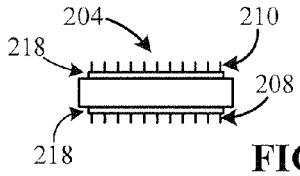
FIG. 10 reveals a an elevation view of the communication port of the depth determination device of FIG. 2 providing communication pins with associated strain relief portions
Figure 11:
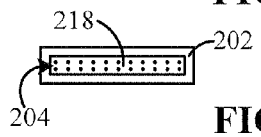
FIG. 11 shows a top plan view of the communication port providing communication pins and associated strain relief portions of the depth determination device of FIG. 2.

The alternative preferred embodiment shown by FIGS.10 and 11 includes an adhesive strip 218 adjacent the communication pin host 202 and enclosing the plurality of communication pins 204. Preferably, when the respective signal cables 212 and 214 are connected to their respective first and second portions 208 and 210 of the plurality of communication pins 204, a high temperature and pressure seal is formed between the signal cables 212 and 214 and their respective first and second portions 208 and 210 of the plurality of communication pins 204 via the adhesive strip 218.

Figure 13:
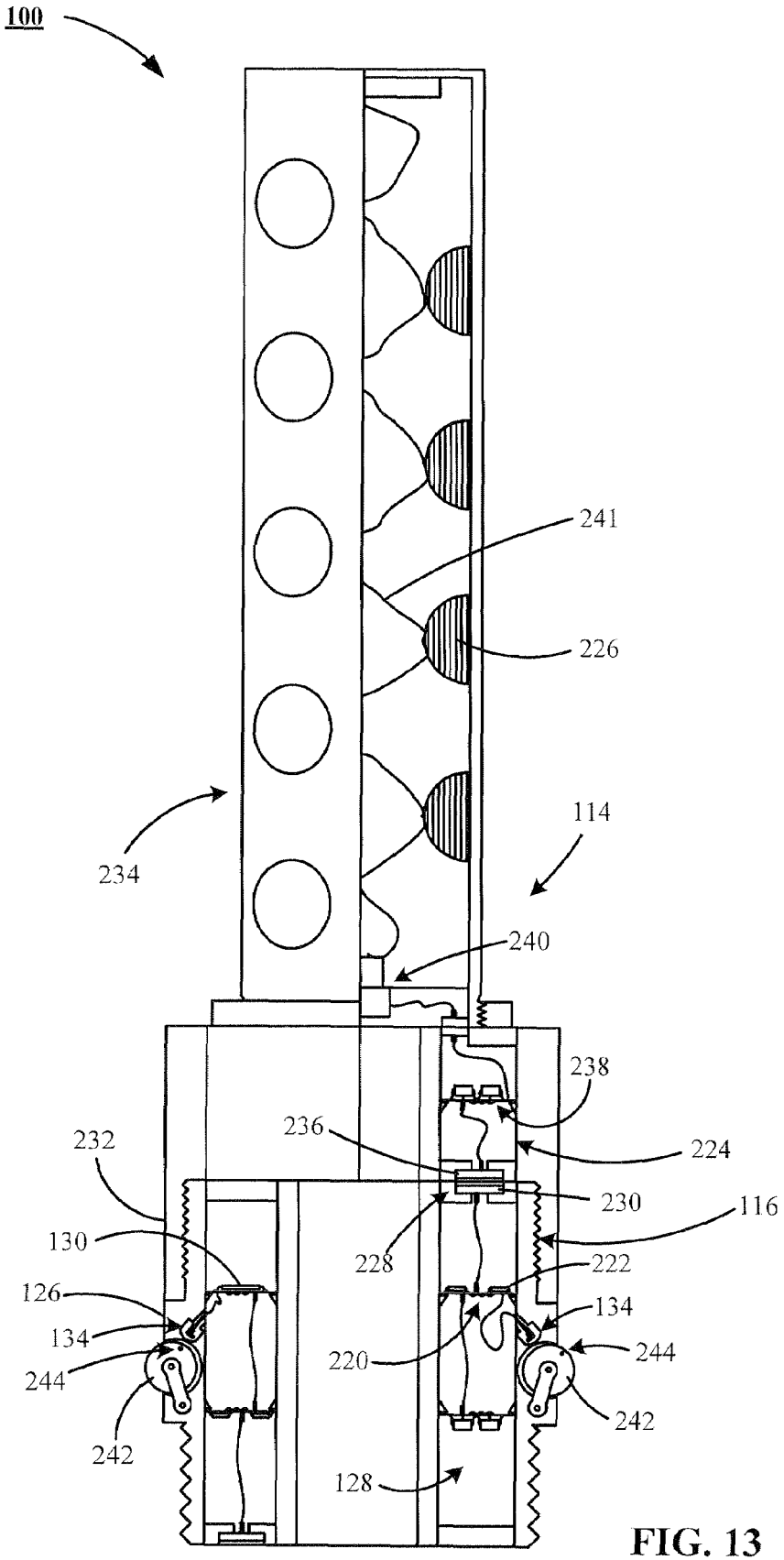
FIG. 13 depicts a cross-sectional view in elevation of the depth determination device of FIG. 2 fitted with a perforation gun.

In the preferred embodiment shown by FIG. 13 the downhole tool delivery system 100 further includes a perforating gun interface and activation module 220 secured within the hermetically sealed electronics compartment 128, communicating with said processor 130 and activating the perforation gun 114 in response to an activation of the well plug 110 (of FIG. 1), conformation of the well 110 plug being set in position within the well casing 104 (of FIG. 1), and the well plug 110 attaining a seal within well casing 104.

Preferably, the perforating gun interface and activation module 220 includes a charge module communication circuit 222 interacting with a charge deployment device 224 of the perforation gun 114, and wherein the perforation gun 114 is secured to the housing 126 via the second attachment portion 116 of said housing 126. And the perforation gun 114 preferably includes at least one shape charge 226, offset a predetermined distance from the attachment portion 116 and positioned to form a perforation, such as 227 (of FIG. 1) through the well casing 104 (of FIG. 1), upon detonation of the shape charge 226 by said charge deployment device 224.

Referring to the preferred embodiment of FIG. 13, the second module attachment portion 116 of the housing 126 provides a communication port 228. The communication port 228 preserves the hermetically sealed electronics compartment 128 while accommodating passage of light. The perforating gun interface and activation module 220 further includes a light source transmitter 230 responsive to the charge module communication circuit 222 for communicating with the charge deployment device 224 of the perforation gun 114.

Further, in the preferred embodiment shown by FIG. 13, the perforation gun 114 includes a perforation device attachment member 232 interacting with the second module attachment portion 116, a support member 234 secured to said attachment member for confinement of the shape charge 226, wherein preferably, the charge deployment device 224 is interposed between the shape charge 226 and the attachment member 232. The charge deployment device 224 preferably detonates the shape charge 226 in response to an activation of the light source transmitter 230. In a preferred embodiment, detonation of the shape charge 226 of the perforation gun 114 will shatter the support member 234 into small pieces allowing it to fall below the perforations (such as 227 of FIG. 1.)

Preferably, the charge deployment device 224 includes a light source receiver 236 configured for receipt of light from the light source transmitter 230, a detonation circuit 238 (also referred to herein as a perforation device activation circuit) as a communicating with the light source receiver 236, and a detonator 240 (also referred to herein as a gun activation mechanism) interposed between the shape charge 226 and the detonation circuit 238. In a preferred operation of the downhole tool delivery system 100, the detonator 240 detonates the shape charge 226 via a primer cord 241 in response to a detonation signal (not separately shown) provided by the detonation circuit 238.

Continuing with FIG. 13, in an alternate embodiment the location sensors 134 are positioned inboard the housing 126, and spring loaded followers 242, that include a magnetic post 244, engage the well casing 104 (of FIG. 1). Preferably, each time the magnetic posts 244 pass in front of the location sensors 134, a signal is generated by the location sensors 134 signaling that the housing 126 has moved a distance substantially equal to the circumference of the followers 242.

Figure 14:
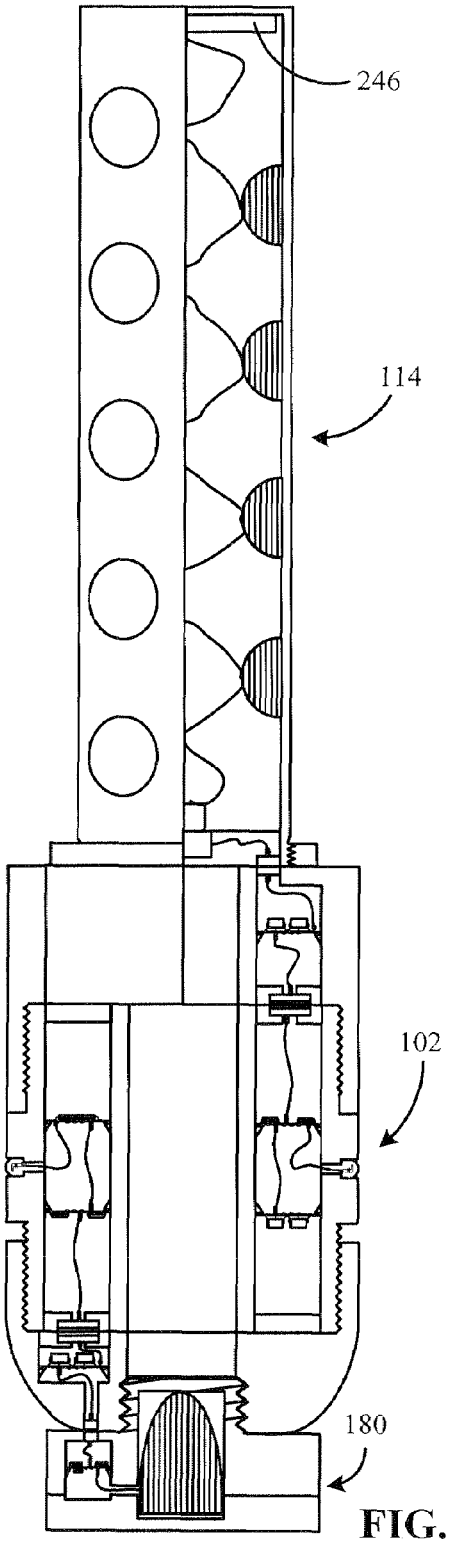
FIG. 14 portrays a cross-sectional view in elevation of the depth determination device of FIG. 2 fitted with the core plug of FIG. 12 and the perforation gun of FIG. 13.
Figure 15:
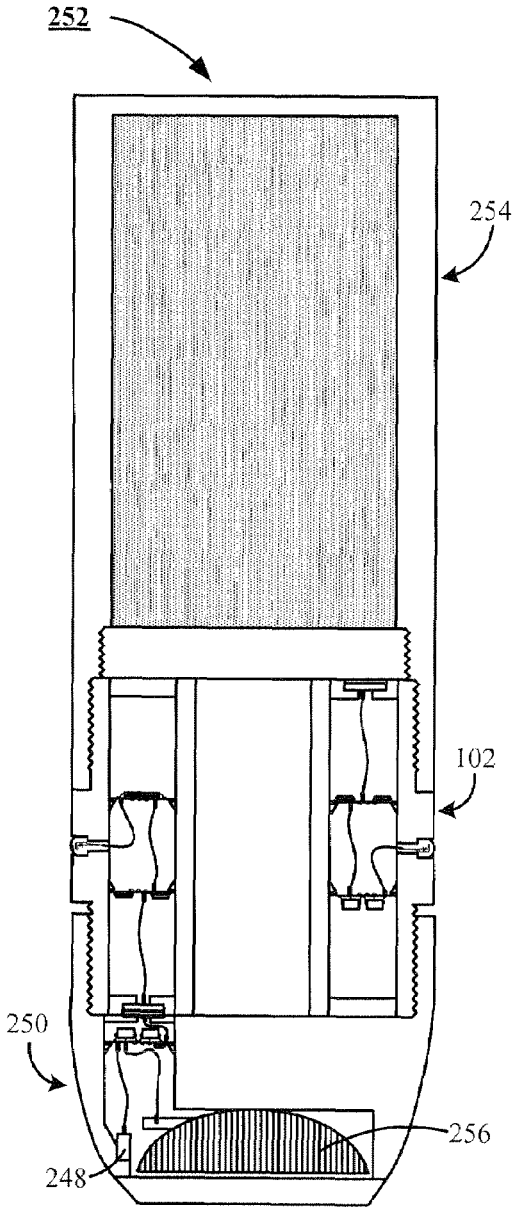
FIG. 15 reveals a cross-sectional and partial cross-sectional view in elevation of the depth determination device of FIG. 2, fitted with shape charge on a proximal end and a weight on a distal end thereby forming a backup fire control assembly.

The preferred embodiment of the perforation gun 114 of FIG. 14 provides a magnetic disc 246, which interacts with a read switch 248 of a nose cone 250 secured to the depth determination device 102 of a chaser tool 252 of FIG. 15. Further shown by FIG. 15 is a sinker mass 254 secured to the depth determination device 102, and configured to promote advancement of the nose cone 250 into adjacency with the magnetic disc 246 (of FIG. 14). The nose cone 250 preferably provides a shape charge 256, which is triggered by the depth determination device 102 attaining a predetermined depth, and the read switch 248 being activated by sensing the presence of the magnetic disc 246. The chaser tool 252 is employed to detonate the perforation gun 114, if it has been determined that the perforation gun 114 has been correctly positioned within the well casing 104 (of FIG. 1), but has failed to detonate.

Figure 16:
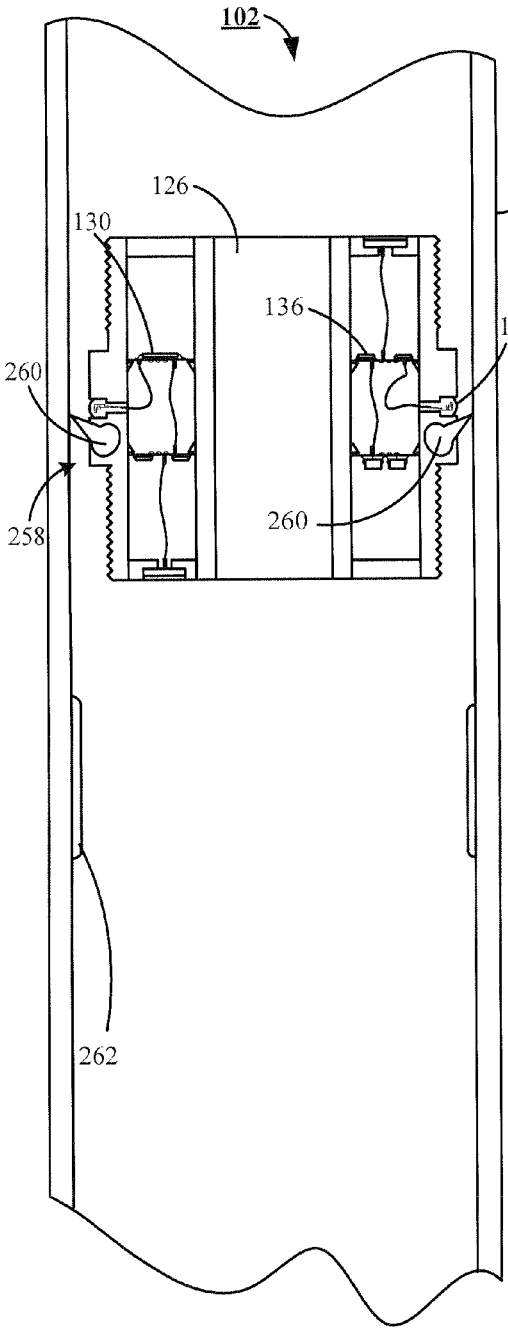
FIG. 16 illustrates a cross-sectional view in elevation of the location sensing system of the depth determination device interacting with the well casing of FIG. 1.
Figure 17:
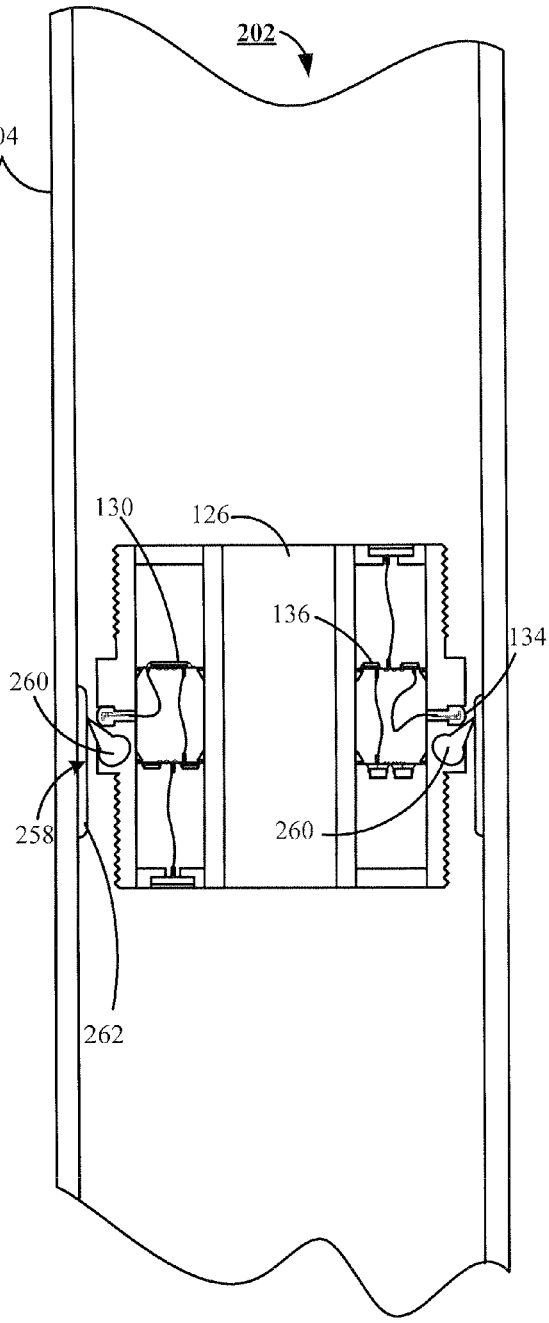
FIG. 17 depicts a cross-sectional view in elevation of the location sensing system of the depth determination device of FIG. 2 interacting with a baffle ring of the well casing of FIG. 1.

It is preferable to view FIGS. 16 and 17 in tandem, because disclosed by FIGS. 16 and 17 is an alternative input mechanism 258 for the sense circuit 136. In addition to the location sensors 134, which communicate with a sense circuit 136 to determine a location of the housing 126 within the well casing 104, the alternative input mechanism 258 provides at least one feeler 260, which interacts with the internal surface of the well casing 104.

Preferably, baffle rings 262 are pre-positioned within the well casing 104 at predetermined positions along the well casing 104. As the depth determination device 102 progresses along the interior of the well casing 104, the location sensors 134 are in a normally open state. However, as the feeler 260 passes by the baffle 262, the feeler 260 is brought into adjacency with the location sensors 134, which causes the location sensors 134 to switch from a normally open state to a closed state, thereby generating a signal for use by the processor 130 in determining the location and velocity of the depth determination device 102 within the well casing 104.

Figure 18:
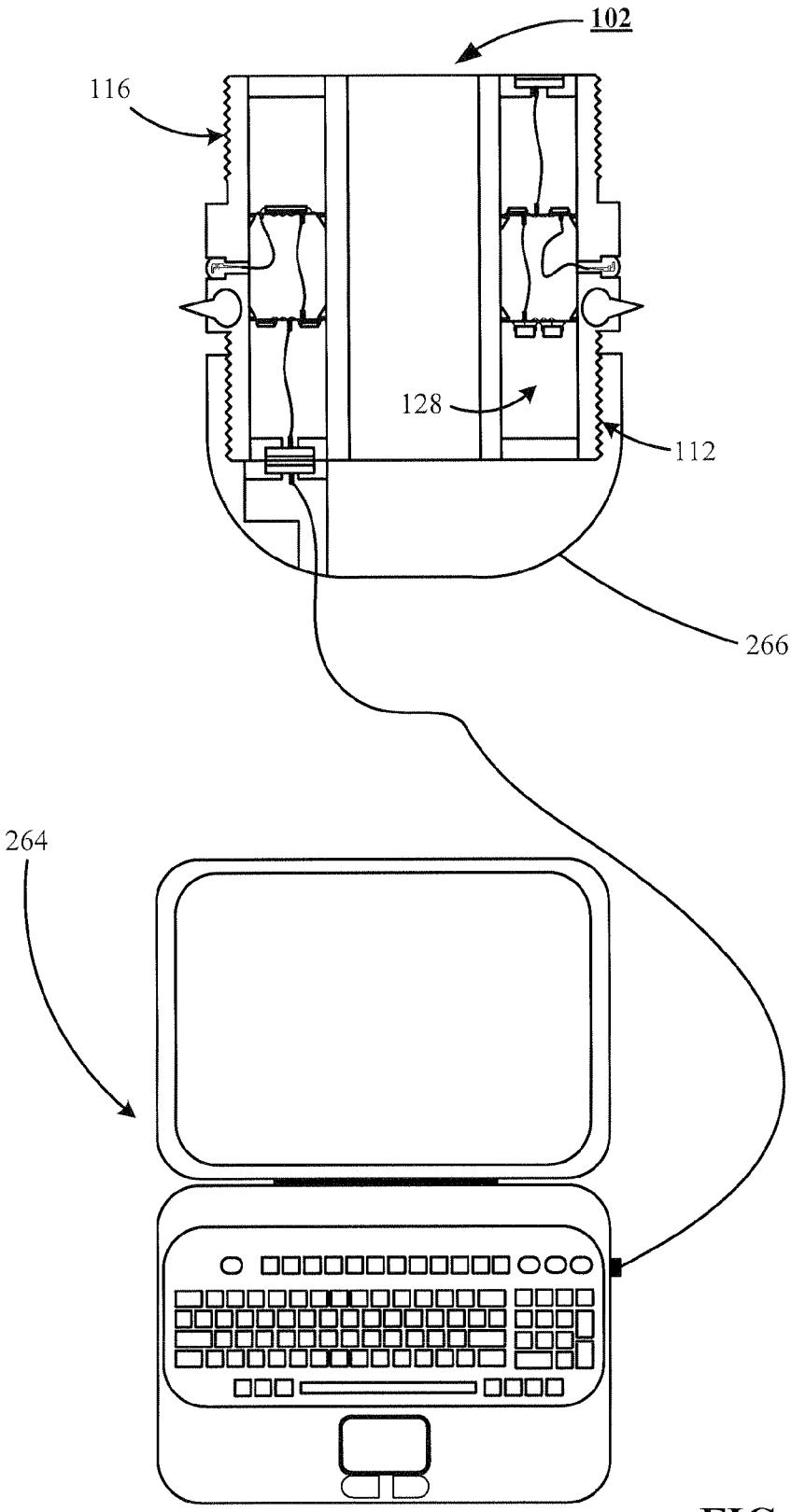
FIG. 18 shows a cross-sectional elevation view of the depth determination device of FIG. 2 fitted with a programming module communicating with a programming device.

FIG. 18 illustrates a preferred technique for downloading control ware, i.e. software and firmware, and map data into the electronics of the depth determination device 102. The preferred technique utilizes a computer 264 communicating with a programming nose cone 266 (also referred to herein as a programming module) secured to the depth determination device 102. In addition to utilizing the computer 264 and programming nose cone 266 to download control ware and map data into the electronics of the depth determination device 102, the computer 264 and programming nose cone 266 are utilized to perform diagnostics on the electronics of the depth determination device 102.

Figure 19:
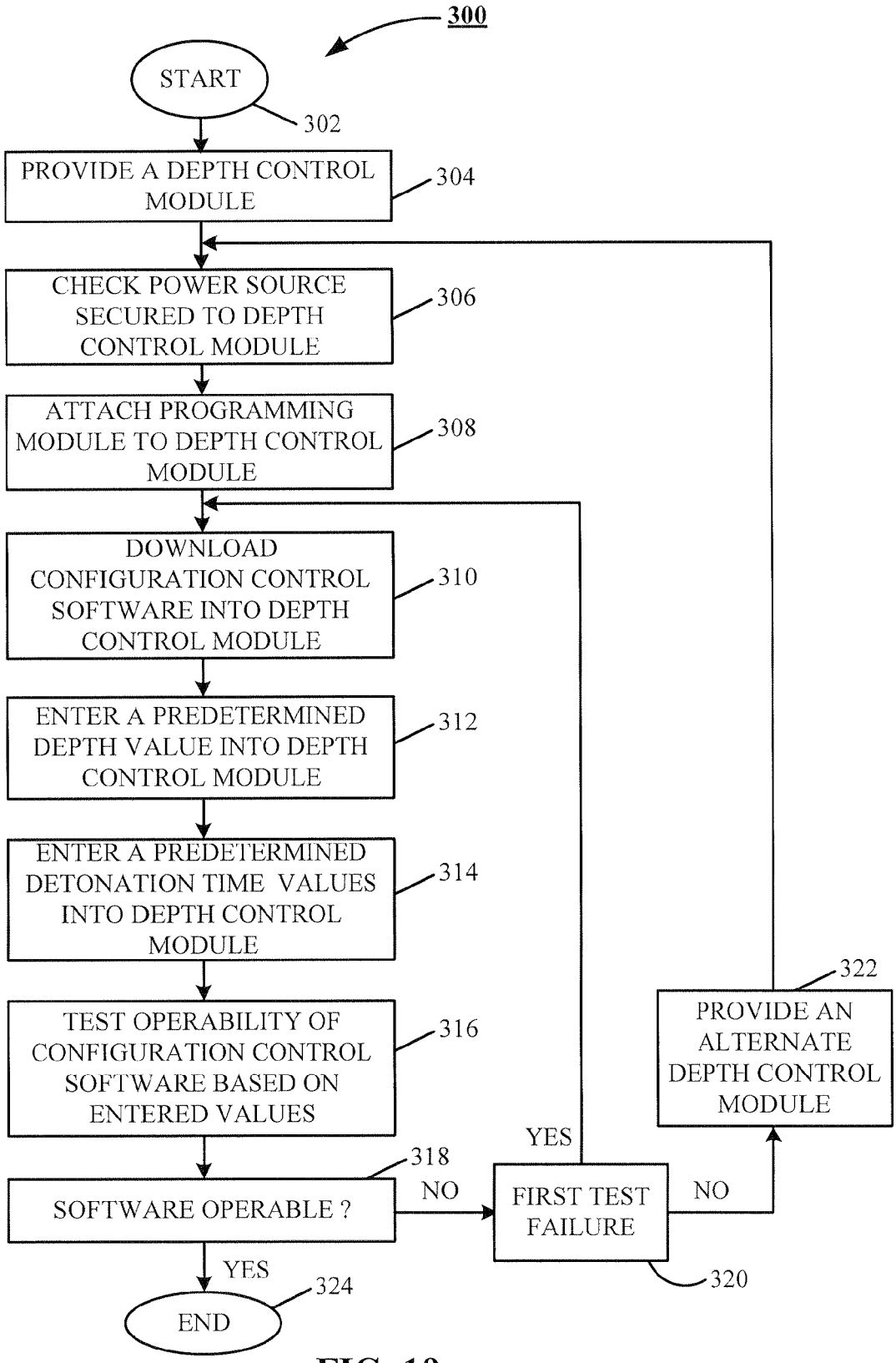
FIG. 19 portrays a flow chart of a method of programming the depth determination device of FIG. 2.

Turning to FIG. 19, shown therein is a flow chart 300 that depicts process steps of a method for preparing a depth determination device (such as 102) for use by a downhole tool delivery system (such as 100). The method commences at start process step 302 and proceeds to process step 304 with providing a depth control module (such as 132) secured within a hermetically sealed electronics compartment (such as 128) of the depth determination device. At process step 306, a power source (such as 216) is checked to assure sufficient energy is present to power the depth determination device. Following the affirmation that the power source contains sufficient energy, at process step 308, a programming module (such as 266) is attached to the depth determination device.

At process step 310, configuration control software is downloaded into the depth control module, and at process step 312, a predetermined depth value is entered into the depth control module. At process step 314, predetermined destination time values are entered into the depth control module. At process step 316, based on the entered destination time values and predetermined depth value, the operability of the configuration control software is tested by a computer (such as 264), and at process step 318 the computer determines whether the downloaded software is operable.

If a determination is made that the downloaded software is inoperable, the method for preparing a depth determination device 300 proceeds to process step 320, where a determination is made as to whether the test failure represents a first test failure of the depth determination device. If the failure is a first test failure, the method for preparing a depth determination device 300 returns to process step 310, and progresses through process steps 310 through 318.

However, if the test failure represents a test failure subsequent to the first test failure of the depth determination device, the method for preparing a depth determination device 300 proceeds to process step 322, and progresses through process steps 306 through 318. If a determination of software operability is made at process step 318, the process concludes at end process step 324.

Figure 20:
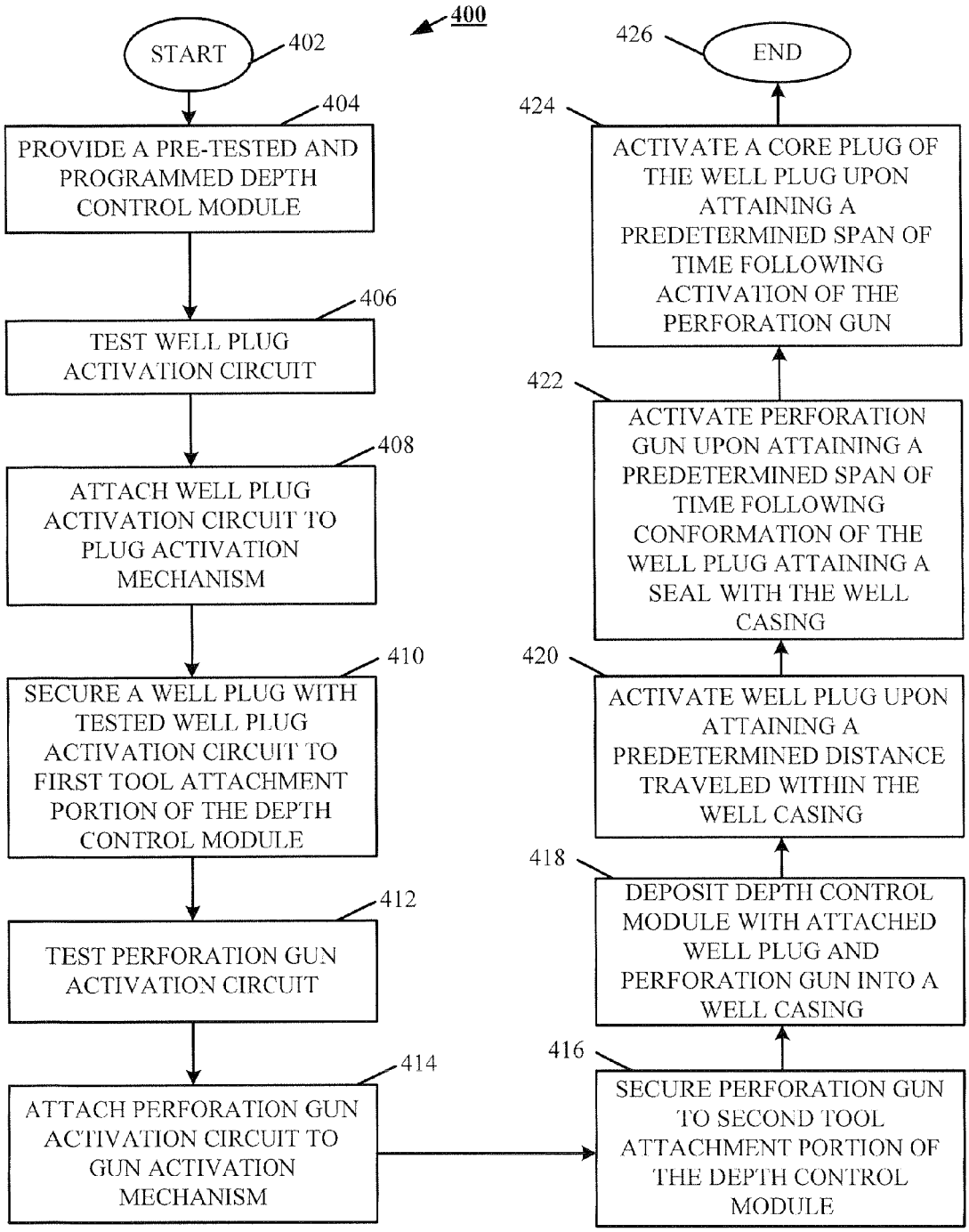
FIG. 20 reveals a flow chart of a method of assembling and using the inventive downhole tool delivery system of FIG. 1

FIG. 20, illustrates a flow chart 400, showing process steps of a method for utilizing a downhole tool delivery system (such as 100). The method commences at start process step 402 and proceeds to process step 404 with providing a pretested and programmed depth control module (such as 132), secured within a hermetically sealed electronics compartment (such as 128) of a depth determination device (such as 102). At process step 406, a well plug activation circuit (such as 150) is tested to assure operability of the well plug activation circuit. Following an affirmation that the well plug activation circuit is operable, at process step 408 the well plug activation circuit is attached to a plug activation mechanism (such as 154).

At process step 410, a well plug (such as 110) with a tested well plug activation circuit is secured to a first tool attachment portion (such as 112) of the depth control module. At process step 412, a perforation device activation circuit (such as 238) of a perforation gun (such as 114) is tested. Upon attaining a satisfactory result from the test, the perforation device activation circuit is attached to a gun activation mechanism (such as 240) at process step 414, and the perforation gun is attached to a second tool attachment portion (such as 216) at process step 416.

At process step 418, the depth control module, with attached perforation gun and well plug, is deposited into a well casing (such as 104). At process step 420, the well plug is activated upon attainment by the depth control module of a predetermined distance traveled within the well casing. Following conformation of the well plug attaining a seal with the well casing, and passage of a predetermined period of time following the confirmed seal, the perforation gun is activated at process step 422.

At process step 424, a core plug (such as 180) activated following a predetermined span of time following deployment of the perforation gun, and the process concludes at end process step 426.

Returning to FIG. 4, it will be noted that in the embodiment of the depth determination device 102 shown therein, the first and second module attachment portions (112 and 116) are depicted with threads of different pitch. By providing module attachment portions with threads of different pitch, a level of control of the type of tools that are attachable to each module attachment portion (112 an 116) may be maintained. However, as shown by the preferred embodiment of the depth determination device 102 illustrated in FIG. 18, the first and second module attachment portions (112 and 116) are depicted with threads of the same pitch.

In the preferred embodiment of the depth determination device 102 illustrated in FIG. 18, any tool configured for attachment to the depth determination device 102 may be attached to either the first or second module attachment portions (112 and 116). Upon attachment of a tool to either first or second module attachment portions (112 and 116), the electronics housed within the hermetically sealed electronics compartment 128 queries the attached tool to determine precisely what tool, and that particular tools configuration.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. An apparatus comprising:

a wellbore commencing at a surface and confining a well casing;

a depth determination device in sliding communication with said well casing, said depth determination device providing a module attachment portion configured for direct attachment and detachment of a down hole tool to said depth determination device, and a hermetically sealed electronics compartment;

a processor secured within said hermetically sealed electronics compartment;

an electronic location sensing system integrated within said hermetically sealed electronics compartment, and communicating with said processor, said electronic location sensing system interacting exclusively with features of said well casing to electronically determine a location of said depth determination device within said well casing, in which said depth determination device is physically connected with said surface via at most a fluidic material, and further in which said electronically determined location of said depth determination device within said well casing is data used by said processor and wherein said electronically determined location of said depth determination device within said well casing is available at said surface only upon retrieval of said depth determination device from said well casing to said surface; and a hermetically sealed communication port provided by said module attachment portion accommodating a communication of operational commands from said processor to said downhole tool when said downhole tool is attached to said module attachment portion.

2. The apparatus of claim 1, in which said down hole tool is a well plug, and further comprising a well plug interface and activation module secured within said hermetically sealed electronics compartment, communicating with said processor and activating said well plug secured to said depth determination device in response to said location sensing system detecting an attainment of a predetermined location within said well casing.

3. The apparatus of claim 2, in which said well plug interface and activation module comprises a well plug communication circuit interacting with a well plug deployment device of said well plug, and wherein said well plug is secured to said housing via said module attachment portion.

4. The apparatus of claim 3, in which said well plug comprises a permanent bridge plug enabling a portion of said well casing below said bridge plug to be sealed from that portion of said well casing above said bridge plug.

5. The apparatus of claim 3, in which said well plug comprises a temporary bridge plug temporarily isolating a portion of said well casing below said temporary bridge plug from an upper portion of said well casing.

6. The apparatus of claim 3, in which said well plug comprises a drillable tool, designed to provide isolation between portions of the well casing.

7. The apparatus of claim 3, in which said well plug comprises a flow through frac plug with a check valve to allow unidirectional flow of fluid from within said wellbore.

8. The apparatus of claim 3, in which said depth determination device provides a second module attachment portion, said hermetically sealed communication port preserving said hermetically sealed electronics compartment while accommodating passage of light, and said well plug interface and activation module further comprising a light source transmitter responsive to said well plug communication circuit for communicating with said well plug deployment device.

9. The apparatus of claim 8, in which said well plug provides a slip portion, cone portion, and seal portion, and in which said well plug deployment device comprises:

a well plug deployment circuit;

a light source receiver interacting with said well plug deployment circuit, and responsive to said light source transmitter for communicating with said well plug deployment circuit;

a set plug charge responsive to said well plug deployment circuit; and a piston adjacent said set plug charge, interacting with said slip portion and expanding said slip portion relative to said cone portion while compressing and expanding said seal portion in response to an activation of said set plug charge by said plug deployment circuit.

10. The apparatus of claim 2, further comprising a perforating device interface and activation module secured within said hermetically sealed electronics compartment, communicating with said processor and activating a perforation device in response to an activation of said well plug, conformation of said well plug being set in position within said well casing, and said well plug attaining a seal within said well casing.

11. The apparatus of claim 10, in which said perforating device interface and activation module comprises a charge module communication circuit interacting with a charge deployment device of said perforation device, and wherein said perforation device is secured to said depth determination device via a second module attachment portion of said housing.

12. The apparatus of claim 11, in which said perforation device is a perforation gun which comprises a shape charge offset a predetermined distance from said attachment portion and positioned to form a perforation through said well casing upon detonation of said shape charge by said charge deployment device.

13. The apparatus of claim 12, in which said second module attachment portion of said depth determination device provides a hermetically sealed communication port, said hermetically sealed communication port preserving said hermetically sealed electronics compartment while accommodating passage of light, and said perforating device interface and activation module further comprises a light source transmitter responsive to said charge module communication circuit for communicating with said charge deployment device of said perforation gun.

14. The apparatus of claim 13, in which said perforation gun further comprises:

a perforation gun attachment member interacting with said second module attachment portion;

a support member secured to said attachment member for confinement of said shape charge; and the charge deployment device interposed between said shape charge and said attachment member, said charge deployment device detonating said shape charge in response to an activation of said light source transmitter.

15. The apparatus of claim 14, in which said charge deployment device comprises:

a light source receiver configured for receipt of light from said light source transmitter;

a detonation circuit communicating with said light source receiver; and a detonator interposed between said shape charge and said detonation circuit, said detonator detonating said shape charge in response to a detonation signal provided by said detonation circuit.

16. An apparatus comprising:

a wellbore commencing at a surface and confining a well casing;

a housing in sliding communication with said well casing, said housing providing a hermetically sealed electronics compartment, a tool attachment portion, and a first flow through core extending through said hermetically sealed electronics compartment and said tool attachment portion;

a processor secured within said hermetically sealed electronics compartment;

an electronic location sensing system integrated within said hermetically sealed electronics compartment, and communicating with said processor while interacting exclusively with features of said well casing to electronically determine the location of said housing within said well casing;

a well plug with a second flow through core affixed to said tool attachment portion, said second flow through core communicating with said first flow through core;

a core plug affixed to said second flow through core prohibiting material flow through said first and second flow through cores; and a core plug release mechanism adjacent said core plug, said mechanism providing separation between said second flow through core and the core plug upon an electronic activation of said mechanism, thereby allowing material to flow through said first and second flow through cores, and in which said housing with affixed well plug is physically connected with said surface via at most a fluidic material.

* * * * *